US009962312B2

(12) United States Patent
Heinrich et al.

(10) Patent No.: US 9,962,312 B2
(45) Date of Patent: May 8, 2018

(54) ROLLATOR WALKER

(71) Applicant: ORTHOSCOOT GMBH, Neusäß/Vogelsang (DE)

(72) Inventors: Frank Heinrich, Augsburg (DE); Andreas Hertle, Aystetten (DE)

(73) Assignee: ORTHOSCOOT GMBH, Neusäss/Vogelsang (DE)

( * ) Notice: Subject to any disclaimer, the term of this patent is extended or adjusted under 35 U.S.C. 154(b) by 0 days. days.

(21) Appl. No.: 15/356,921

(22) Filed: Nov. 21, 2016

(65) Prior Publication Data

US 2017/0143575 A1 May 25, 2017

(30) Foreign Application Priority Data

Nov. 25, 2015 (DE) ..... 20 2015 106 423 U

(51) Int. Cl.
*A61H 3/04* (2006.01)
*A61H 3/00* (2006.01)

(52) U.S. Cl.
CPC ..... *A61H 3/04* (2013.01); *A61H 3/00* (2013.01); *A61H 2003/005* (2013.01);
(Continued)

(58) Field of Classification Search
None
See application file for complete search history.

(56) References Cited

U.S. PATENT DOCUMENTS 7,303,537 B1 12/2007 Snyder et al.
8,302,985 B2 * 11/2012 Ruby ..... A61G 5/12 280/304.1
(Continued)

FOREIGN PATENT DOCUMENTS

FR 2398659 A1 2/1979
FR 3002436 A1 8/2014
(Continued)

OTHER PUBLICATIONS

Result of search report for German Application No. 20 2015 106 423.3 filed Nov. 25, 2015, one page.
European Search Report dated Mar. 15, 2017 for EP 3 173 059 A1.

*Primary Examiner* — John D Walters
*Assistant Examiner* — Hilary L Johns
(74) *Attorney, Agent, or Firm* — Paul D. Bianco; Katharine Davis; Fleit Gibbons Gutman Bongini & Bianco PL

(57) ABSTRACT

A rollator walker with a travel carriage, a frame, and a support for a person's leg, the inclination of which, with respect to a horizontal plane in the direction of the longitudinal axis of the support, can be adjusted. The support is mounted on a supporting part, which is firmly connected to the frame via a joint with a first axle which is horizontal and transverse with respect to the longitudinal axis of the support, and via a supporting element which is at a distance from the first axle in the direction of the longitudinal axis of the support. The supporting element is connected to the supporting part via a manually adjustable mechanical positioning element, by which the vertical position of the supporting element can be changed with respect to the supporting part. As a result, the inclination of the support is adjustable without loss of stability, and the support is held securely in any set inclination position.

20 Claims, 4 Drawing Sheets

(52) U.S. Cl.
CPC ..... *A61H 2201/0192* (2013.01); *A61H 2201/164* (2013.01); *A61H 2205/10* (2013.01)

(56) References Cited

U.S. PATENT DOCUMENTS

| | | | | |
|---|---|---|---|---|
| 2001/0038186 | A1 | 11/2001 | Wychozowycz | |
| 2005/0121873 | A1 | 6/2005 | Miller | |
| 2007/0216122 | A1 * | 9/2007 | Cornelius ..... | A61H 3/00 280/87.05 |
| 2011/0109058 | A1 | 5/2011 | Janis et al. | |

FOREIGN PATENT DOCUMENTS

| | | | |
|---|---|---|---|
| GB | 108777 | A | 8/1917 |
| GB | 2010194 | A | 6/1979 |
| WO | 0074625 | A1 | 12/2000 |
| WO | 2010/099270 | A1 | 9/2010 |

* cited by examiner

ROLLATOR WALKER

FIELD OF THE INVENTION

The invention relates to a rollator walker.

BACKGROUND

Walkers of this type are used to enable a person whose leg or foot has been injured to move without placing a load on the injured leg or foot in order to avoid impairing the healing process by such a load. Locomotion with such a walker is similar to using a treadmill, wherein, in order to remove the load from the injury, the injured leg, or the leg with the injured foot, rests at an angle with respect to the thigh on an approximately horizontal, elongated support, so that the walker, and not the injured leg or foot, receives the weight of the body when the injured leg or the leg with the injured foot is exposed to a load. For the individual adaptation to the anatomy of a user, it is known to use a design making it possible to adjust not only the height of the support for the thigh in such walkers, but also the inclination of the support in the longitudinal direction of the support, i.e., in the direction of travel of the walker.

FR 3 002 436 A1, for this purpose, provides a rotary mounting of the support at the end of a vertically upwardly protruding support tube in a pivot joint with a horizontal axis. From the bottom side of the support, two semicircular disks that are parallel to one another each protrude away along bores distributed over its periphery. After a pair of bores of the disks, which are to be selected in accordance with the desired inclination of the support, are correctly aligned with respect to a pair of bores in the support tube beneath the axle, the support can be attached at the selected inclination by passing a bolt through the bores and securing the bolt. The disadvantage here is that the pivot joint is temporarily exposed to the load of the entire body weight of the user of the walker and therefore must be implemented in solid form from a high-strength, and consequently expensive, material, and that the adjustment of the inclination is possible only in relatively large steps.

A similar solution is known from US 2007/0216122 A1. In order to enable a stepless adjustment of the angle of inclination, instead of individual bores, guide slots are provided here along the periphery of the disks protruding downward from the support. For attaching the support at a selected inclination, the disks are clamped by means of a wing nut protruding through the guide slots and through bores in the support tube against the support tube. This is thus a frictional connection, the establishment of which requires a relatively high expenditure of force, which here as well requires a solid construction and a high-strength material. Moreover, if the clamping force is too small, the connection can become loose with time under load.

SUMMARY

Starting with this state of the art, a rollator walker is disclosed with adjustment of the inclination of the support, wherein the support is held in a stable and secure manner in any set inclination position.

Advantageous implementations and modifications are also disclosed.

A rollator walker with a travel carriage, a frame, and a support for a person's leg, the inclination of which is adjustable with respect to a horizontal plane in the direction of the longitudinal axis of the support, is characterized according to the invention in that the support is mounted on a supporting part which is firmly connected to the frame via a joint with a horizontal first axle transverse with respect to the longitudinal axis, and via a supporting element which is at a distance from the first axle in the direction of the longitudinal axis of the support and which is connected to the supporting part by means of a manually adjustable mechanical positioning element, by means of which the vertical position of the supporting element with respect to the supporting part can be changed.

This results in a mounting of the support on the frame which has high mechanical stability due to the two supports which are at a distance from one another in the direction of the longitudinal axis of the support, and which enables the user to perform, by means of the positioning element, an adjustment of the inclination via the vertical position of one of the two supports.

The implementation of the supporting element, as a second axle, which is rotatably mounted as a part of the additional joint parallel to the first axle on the support, is advantageous. As a result, one degree of freedom of the movement is already created, which considerably simplifies the implementation of the positioning element. By means of the connection of the second axle to a third axle, which, as part of an additional joint, is rotatably mounted parallel to the first axle and to the second axle on the supporting part in a fixed position, perpendicularly beneath the second axle, via a rod, the position of which is adjustable with respect to the third axle, an additional simplification is achieved, in that a purely linear movement of the rod with respect to one of the two axles connecting said rod is already sufficient for implementing the inclination adjustment of the support.

The positioning element is advantageously a self-locking actuator. This ensures an independent and stable attachment of the set inclination without additional effort. Such a self-locking actuator can be implemented in a particularly simple manner in that the second axle is connected to the third axle via a rod having threads, in such a way that a rotation of the rod about its longitudinal axis via the threads results in a change in the distance between the second axle and the third axle. For this purpose, the rod need not be provided with threads along its entire length, but instead it is sufficient if a threaded section be provided. A rotation of the rod is converted first by the threads into a linear movement, which in turn is converted into a swiveling of the support about the first axle. The threads convert a rotation of the rod in accordance with its inclination into a relatively small linear movement, and in this way enables a very fine setting of the inclination of the support. In addition, it has the property of self-locking, which makes it possible to dispense with an additional element for the fixation of a set inclination. However, such a fixing element can nonetheless be provided for safety reasons, for example, in the form of a fixing pin or a fixing bolt, or a cotter pin.

Preferably, the rod is rotatably mounted to the second axle in a radial bore, and to the third axle in the threads of a radial threaded bore. As a result, the position of the rod relative to the second axle remains unchanged in the case of an adjustment of the inclination of the support, so that in this area the rod does not require any play for a linear shifting, thus making possible a compact implementation of the mounting of the second axle on the support.

Preferentially, the rod extends through the third axle, and an end section of the rod extending over and past the third axle is provided with a grip, by means of which its rod can be manually rotated. This arrangement of an actuation grip for the manual adjustment of the inclination of the support is particularly advantageous from an ergonomic standpoint and largely prevents inadvertent adjustment.

A particularly simple and appropriate connection of the rod to the second axle consists in the rod having an offset on which the second axle rests, wherein an end section of the rod extends into or through the bore of the second axle and is secured there by a securing means against release from the bore.

Alternatively to a threaded rod, the positioning element can also comprise a rod bent into the form of a segment of a circle. In this case, it is not necessary to provide in each case a rotatably mounted axle for the connection to the support and to the supporting part, since the circular path over which each point on the support travels when said support rotates about the longitudinal axis of the first axle can be to traced using a corresponding radius of curvature of a rod into the form of a segment of a circle. Such a rod can be firmly connected to the bottom side of the support, and it can protrude shiftably through an opening in the support part, wherein it can be attached either in a stepless or a stepped manner with respect to the supporting part.

Preferably, a rod without threads, which is bent into the form of a segment of a circle, engages in a radial bore in a second axle and/or in a radial bore in a third axle, since the use of at least one rotary axle within the positioning element creates an additional degree of freedom, by means of which the movement of the rod during the adjustment of the inclination of the support is facilitated, and the risk of jamming is decreased. Advantageously, in this embodiment, the rod can be shifted through the radial bore in the third axle, and an end of the rod is connected by a joint in the second axle in such a manner that a shifting of the rod through the radial bore in the third axle produces a change in the distance between the second axle and the third axle, wherein the position of the rod can be fixed with respect to the third axle by means of a fixing element.

The advantageously detachable connection of the supporting part to the frame results in the possibility of premounting the adjustment mechanism for the inclination of the support separately from the remaining components of the walker, and of fastening the support together with the adjustment mechanism as a finished module to the frame.

From a medical standpoint, it is reasonable if the adjustment range of the angle of inclination of the longitudinal axis of the support with respect to the horizontal plane in the direction of travel of the walker be between −10° and +25°, preferably between −3° and +15°.

It is advantageous if the support comprises a shell and a pad detachably fastened to the top side of the shell. This results in the possibility of replacing the pad on which the leg of a person directly rests when the walker is in use, if needed. Such a need for replacement can arise during the course of the healing process of an injury to a leg or foot, or from the need to have the walker be used successively by different people having a different anatomy of the leg that is to be supported, for example, a different thigh diameter. A particularly appropriate form of the detachable fastening of the pad to the shell consists in using at least one hook-and-loop fastener as fastening element.

BRIEF DESCRIPTION OF THE DRAWINGS

Below, an embodiment example of the invention is described with reference to the drawings. The drawings show FIG. 1 a side view of a walker according to the invention, FIG. 2 a perspective view of a part of the walker of FIG. 1 with an inclination adjustment mechanism for the support, FIG. 3 a longitudinal sectional view of the part of a walker of FIG. 2 in the maximally inclined position, FIG. 4 a side view of the part of a walker of FIG. 2 in an approximately horizontal position, and FIG. 5 an exploded view of the part of a walker according to FIG. 2.

DETAILED DESCRIPTION

Figure 1:
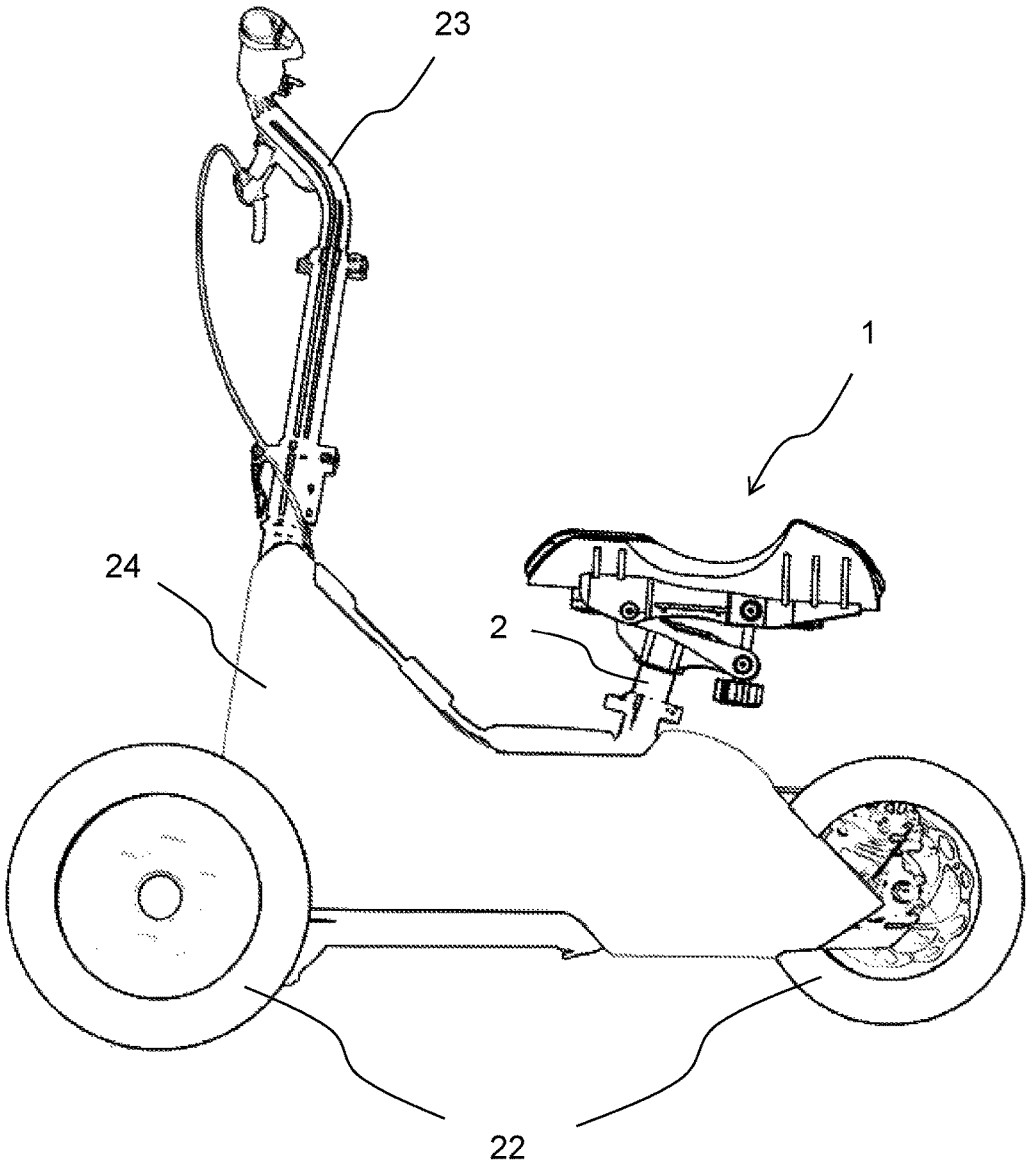

A walker according to the invention, as can be seen in a side view in FIG. 1, includes, as main components, a travel carriage 22 that can be steered by means of a steering rod 23, a frame 24, and a support 1 for the leg or thigh of a patient whose mobility is to be facilitated by means of the walker.

Figure 2:
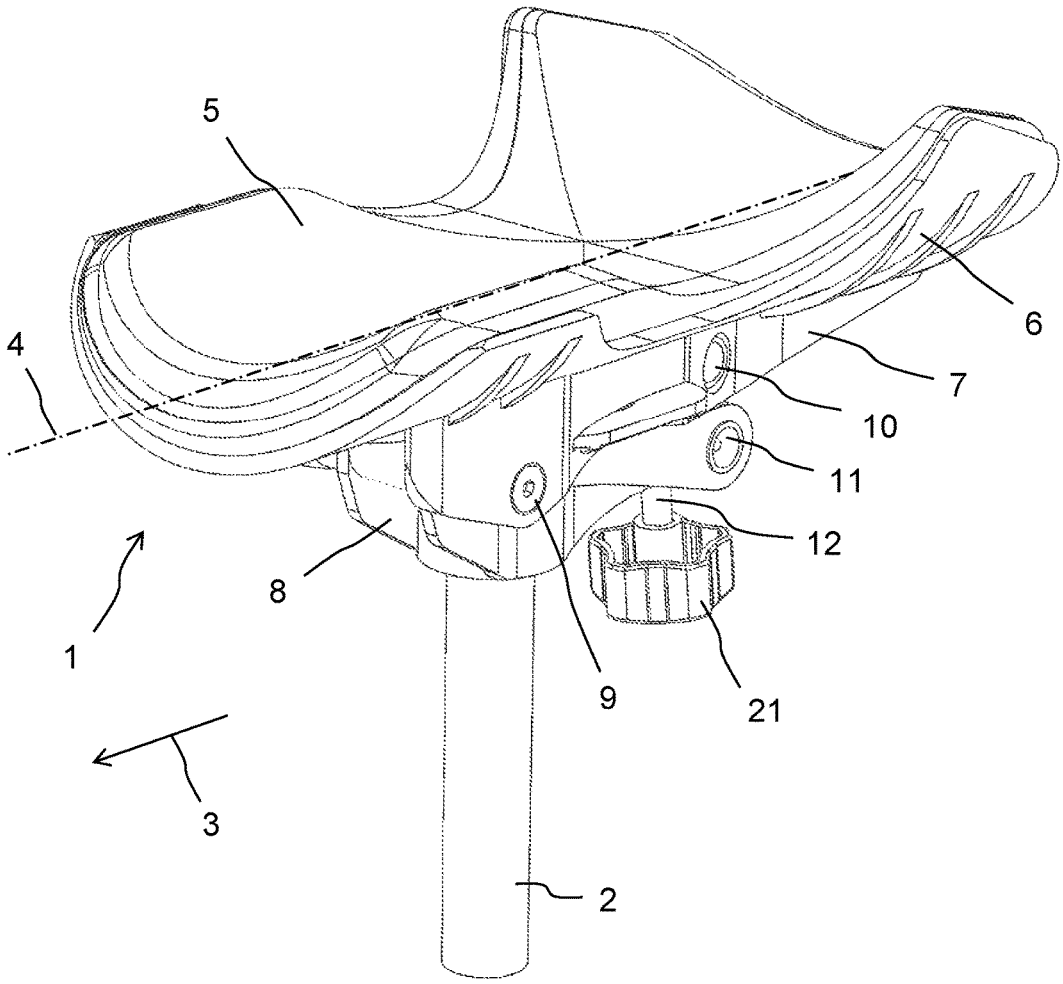
Figure 3:
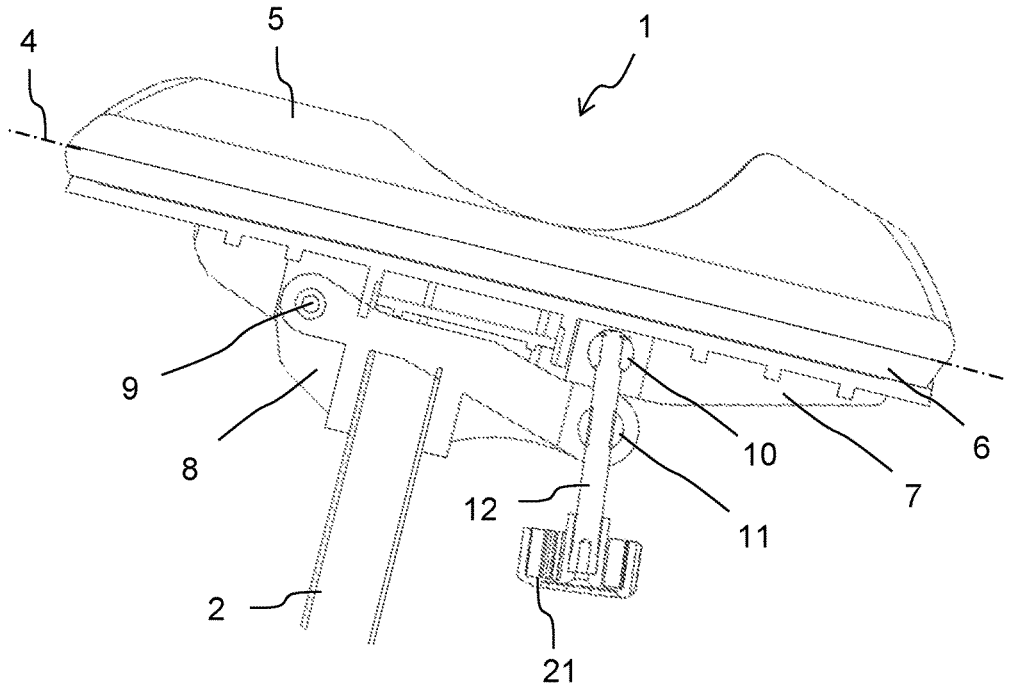
Figure 4:
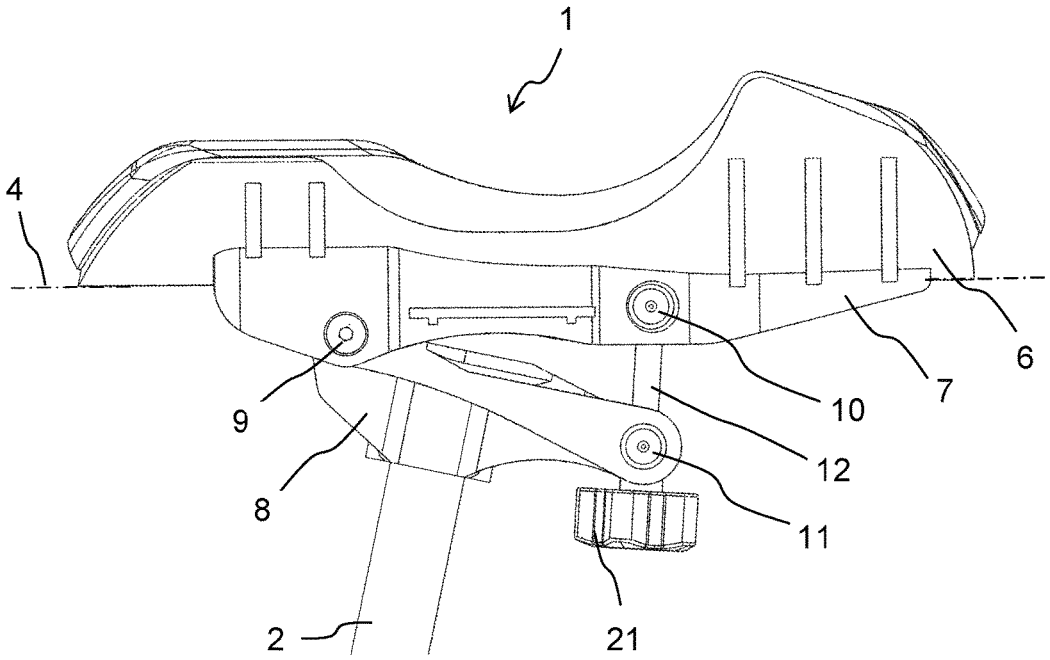

The support 1, shown enlarged in FIG. 2, is arranged at the upper end of a tube 2, which, starting from the frame 24 of the walker, extends upwards with a slight inclination with respect to the vertical direction. The intended direction of travel of the rollator walker is indicated by the arrow 3 in FIG. 2. The support 1 has substantially the approximate form in cross section of a semicircular channel with a longitudinal axis 4 and with open longitudinal ends, and is provided with a pad 5 on its upper side. The inclination of the support 1 is adjustable in its longitudinal direction, which corresponds to the direction of travel 3, i.e., the angle of the longitudinal axis 4 with respect to the horizontal plane can be varied within a predetermined range. An embodiment of this inclination adjustment of the support 1 according to the invention is explained below with reference to FIGS. 3 to 5.

The support 1 consists of a longitudinal shell 6 and a mounting adapter 7 extending along its bottom side, and is firmly connected to the shell 6 or is designed so as to form a single piece with said shell. In particular, the shell 6, together with the mounting adapter 7, can be produced as a single-piece injection-molded part made of plastic. The mounting adapter 7 is movably connected to a supporting part 8, which is firmly connected to the tube 2 and which can also be an injection-molded part. A first joint is formed by a first axle 9 in the form of a bolt that is inserted into bores of the mounting adapter 7 and of the supporting part 8 that are aligned with one another and secured there. The axle 9 rests horizontally and transversely with respect to the longitudinal axis 4 of the support 1. A second joint is formed by a second axle 10 in the form of an additional bolt inserted into two aligned bores of the mounting adapter 7. The first axle 9 and the second axle 10 are located parallel to one another and successively in the direction of the longitudinal axis 4 of the support 1 at a distance which represents a significant portion (in the depicted embodiment example, approximately one third) of the length of the shell 6.

The second axle 10 is connected by means of a rod 12 to a third axle 11 in the form of an additional bolt, which is inserted into two aligned bores of the supporting part 8. The third axle 11 is located on the supporting part 8 perpendicularly beneath the second axle 10 and is parallel to said second axle, and thus also to the first axle 9. The rod 12 passes through the two axles 10 and 11, in each case in a radial direction. For the connection to the third axle 11, the rod 12 has threads 13, which are screwed through a radial threaded bore 14 in the axle 11, as can be seen in the exploded view of FIG. 5. The viewing direction of this figure is different from the viewing direction of FIG. 2, as can be seen from the arrow 3, which indicates the direction of travel of the walker. For the connection to the second axle 10, the rod 12 has an offset 15, on which the second axle 10 rests.

At an end section of the rod 12, which extends through a radial bore 16 in the second axle 10, an annular groove 17 is provided, into which a securing ring 18 engages, which secures the end section of the rod 12 in the bore 16. The end section of the rod 12 is rotatably mounted in the bore 16.

The third axle 11 is held in its longitudinal direction on the supporting part 8 in that it has a cutout 19 for the passage of the rod 12 through the third axle 11. The cutout 19 limits the movability of the rod 12 with respect to the supporting part 8 in the longitudinal direction of the third axle 11, and thus also firmly secures the third axle 11 in its longitudinal direction by means of a positive fit connection to the supporting part 8. Similarly, the mounting adapter 7 of the support 1 has a cutout, not visible in the figures, open at the bottom, into which the rod 12 protrudes through the second axle 10. This cutout limits the movability of the rod 12 with respect to the mounting adapter 7 in the longitudinal direction of the second axle 10, and thereby also firmly applies the second axle 10 in its longitudinal direction by means of a positive fit connection against the mounting adapter 7. The fixation of the first axle 9 in its longitudinal direction on the supporting part 8 occurs by means of screws 20, which are screwed axially into the two ends of the axle 9 and which, in each case, form a positive fit connection to the supporting part 8.

The rod 12 creates a movable connection between the second axle 10 and the third axle 11, in that, via the threaded connection of the rod 12 to the third axle 11, by means of a rotation of the rod 12 about its longitudinal axis, the distance between the second axle 10 and the third axle 11 can be varied. For this purpose, at the end of the rod 12, beneath the third axle 11, a twist knob 21 is arranged, which enables a manual rotation of the rod 12 about its longitudinal axis. Due to the fixed positions of the first axle 9 and of the third axle 11 on the supporting part 8, a change in the distance between the second axle 10 and the third axle 11 produces, due to a rotation of the rod 12, a movement of the second axle 10 about the first axle 9 over a circular-path. This means, at the same time, a rotation of the entire support 1 about the first axle 9, as a result of which the angle of the longitudinal axis 4 of the support 1 with respect to the horizontal plane changes.

By a rotation on the twist knob 21, the user can adjust the rollator walker, the components of which are the elements described here, that is, the inclination of the support 1 in the direction of travel 3. In the process, the threaded connection between the rod 12 and the third axle 11 enables a stepless setting of a desired inclination with high precision and little effort. Due to the self-locking of the threaded connection and the arrangement of the twist knob 21 beneath the support 1, which practically rules out an inadvertent adjustment, no securing element for fixing a set inclination is needed. However, it would nonetheless be possible to provide, on the rod 12, a securing element, for example, in the form of a lock nut, possibly implemented as a knurled nut, which can be clamped against the second axle 11.

The first axle 9, in principle, need only be rotatably mounted with respect to the mounting adapter 7 or with respect to the supporting part 8, but not necessarily with respect to both, although the latter option is preferable from the standpoint of mounting technique. Furthermore, the rod 12 need not necessarily occupy an approximately vertical position. Instead, the mounting position of the second axle 10 can also be arranged on a section of the mounting adapter 7, which extends vertically slightly farther downward, and which, as a result, can therefore be offset vertically downward with respect to the first axle 9, and the mounting position of the third axle 11 could be offset on the supporting part 8 with respect to the second axle 10 in the horizontal direction, so that the rod 12 in FIGS. 3 and 4 would have a more pronounced inclined position from the bottom left to the top right. The function according to the invention would also be ensured with an arrangement wherein the change in the angle of inclination of the support 1 per turn of the rod 12 would in this case be smaller than in the depicted embodiment example.

The positioning element can also include, instead of a rod 12 provided with threads 13, a threadless rod, which, however, would then have to be bent into the form of a segment of a circle and which passes through the third axle 11, for example, through a radial bore 14 in the third axle 11. The end of the threadless rod that is bent into the form of a segment of a circle can either be fastened or attached by means of a joint to the bottom side of the mounting adapter 7. At the other end of the rod, a hold button is advantageously arranged, by means of which the position of the rod with respect to the third axle 11 can be set by shifting the rod. When the rod is shifted with respect to the third axle 11, the inclination of the support is changed, as in the above embodiment example of the invention. The selected position of the rod with respect to the supporting part 8 can be established by fixing means or fixing bolts or cotter pins.

Figure 5:
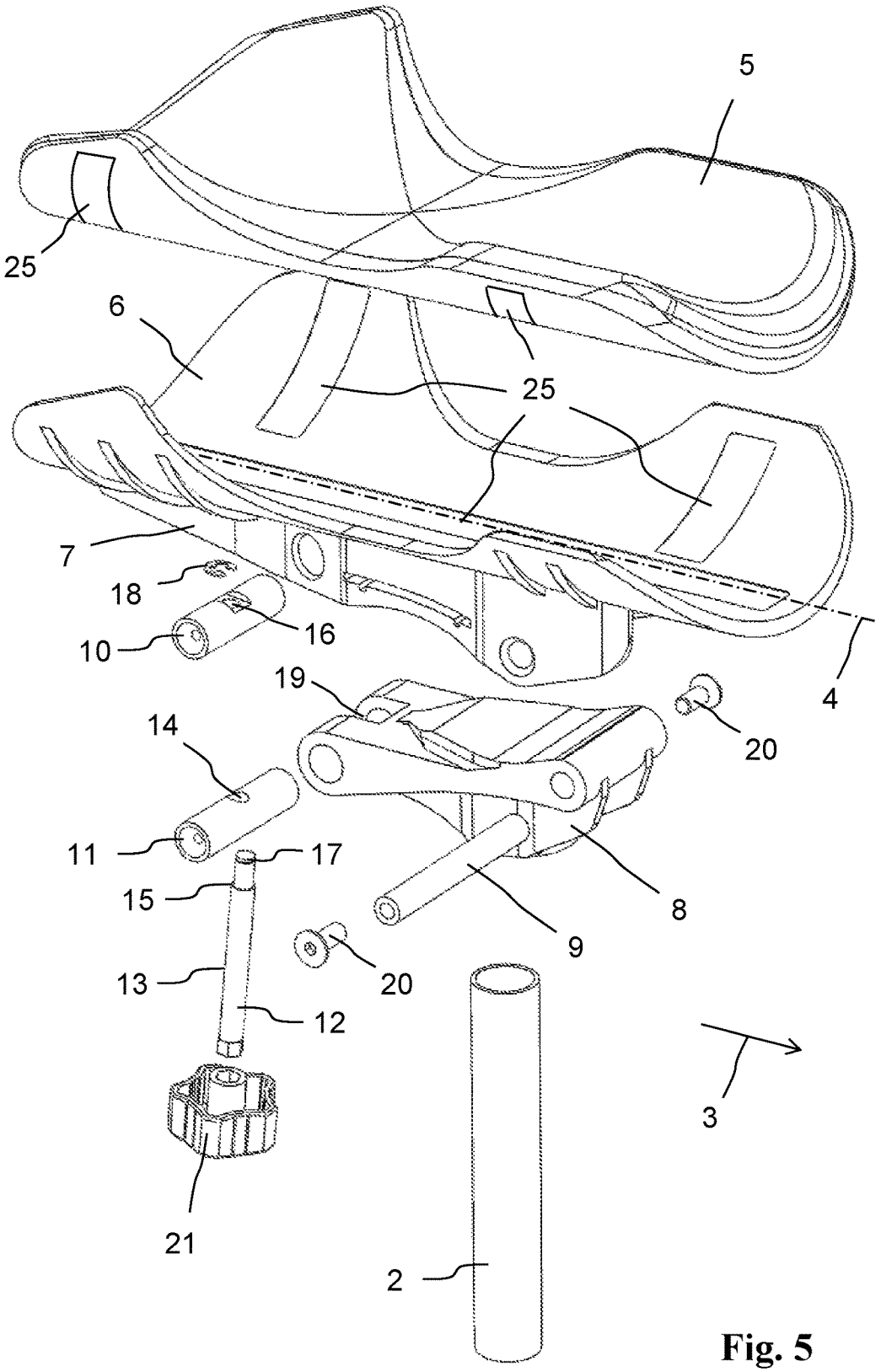

For the detachable fastening of the pad 5 to the shell 6, several hook-and-loop fastener strips 25 are provided, of which, as shown in FIG. 5, one extends on the shell 6 in the center in the direction of the longitudinal axis 4, and, in each case, one extends perpendicularly thereto on the front and on the rear section of the shell. Mating parts are located on corresponding sites of the bottom side of the pad 5. The hook-and-loop fastener strips 25 are firmly connected to the shell or to the pad 5 or, for example, by gluing. Alternatively to the hook-and-loop fastener strips, other types of detachable connections, such as snap fasteners, snap-fits or magnetic strips as well as combinations of different types of detachable connections, can also be provided.

What is claimed is:

1. A walker for facilitating movement of a user, the walker comprising:

a carriage;

a frame;

a supporting part connected to the frame;

a support for a limb of the user having a longitudinal axis and swivel-mounted on the supporting part by a first joint having a first axle arranged transverse to the longitudinal axis of the support, the support having an adjustable inclination with respect to a horizontal plane lying in the longitudinal axis of the support;

a supporting element configured for supporting the support arranged at a distance from the first axle in a direction of the longitudinal axis of the support; and a mechanical-positioning element connecting the supporting element to the supporting part, the mechanical-positioning element configured for manual adjustment;

wherein a vertical position of the supporting element with respect to the supporting part is adjustable using the mechanical-positioning element to thereby adjust inclination of the support for the limb of the user within the horizontal plane.

2. The walker according to claim 1, further comprising a second joint having a second axle connecting the supporting element to the support, the second axle parallel to the first axle and rotatably mounted on the support.

3. The walker according to claim 2, further comprising a third joint having a third axle connected to the second axle, the third axle parallel to the first and second axles and mounted on the supporting part in a fixed position below the second axle.

4. The walker according to claim 1, wherein the mechanical-positioning element is a self-locking actuator.

5. The walker according to claim 3, further comprising a threaded rod connecting the second axle and the third axle and configured such that rotation of the threaded rod on its longitudinal axis changes a distance between the second axle and the third axle.

6. The walker according to claim 5, wherein the second axle has a first radial bore, the third axle has a second radial bore with a thread on an interior surface, and the threaded rod is rotatably mounted on the second axle in the first radial bore and engages the third axle with the thread on the interior surface of the second radial bore.

7. The walker according to claim 5, wherein the threaded rod extends through the third axle such that a portion of an end section of the threaded rod protrudes therefrom.

8. The walker according to claim 7, further comprising a knob arranged at the end section of the threaded rod protruding from the third axle, the knob configured for manual rotation of the threaded rod.

9. The walker according to claim 5, wherein the threaded rod further comprises an offset configured for contacting the second axle, an end section extending into or through a bore in the second axle, and securing elements configured for securing the threaded rod against release from the bore.

10. The walker according to claim 3, wherein the mechanical-positioning element comprises a rod bent into a form of a segment of a circle.

11. The walker according to claim 10, wherein the rod is configured to engage a radial bore in the second axle or a radial bore in the third axle.

12. The walker according to claim 11, wherein the rod further comprises an end section connected to the second axle by a joint and is configured such that shifting of the rod through the radial bore in the third axle produces a change in a distance between the second axle and the third axle.

13. The walker according to claim 10, further comprising a fixing element configured for fixing the rod in position with respect to the third axle.

14. The walker according to claim 1, wherein the supporting part is detachably connected to the frame.

15. The walker according to claim 1, wherein an adjustment range of an angle of inclination of the longitudinal axis of the support with respect to the horizontal plane is between −10° and +25°.

16. The walker according to claim 1, wherein the support for the limb of the user comprises a shell and a pad, the pad detachably fastened with a fastening element to a top side of the shell.

17. The walker according to claim 16, wherein the fastening element is a hook-and-loop fastener.

18. A walker for facilitating movement of a user, the walker comprising:

a carriage standing on a surface;

a frame;

a supporting part connected to the frame;

a support for a limb of the user swivel-mounted on the supporting part by a first joint having a first axle parallel to the surface the carriage is standing on and transverse to a longitudinal axis of the support, the support having an inclination adjustable along the longitudinal axis with respect to the surface the carriage is standing on;

a supporting element configured for supporting the support arranged at a distance from the first axle in a direction of the longitudinal axis of the support;

a second joint having a second axle connecting the supporting element to the support, the second axle parallel to the first axle and rotatably mounted on the support;

a third joint having a third axle connected to the second axle, the third axle parallel to the first and second axles and mounted on the supporting part in a fixed position below the second axle; and a mechanical-positioning element connecting the supporting element to the supporting part, the mechanical-positioning element configured for manual adjustment;

wherein a vertical position of the supporting element with respect to the supporting part is adjustable using the mechanical-positioning element to thereby adjust inclination of the support for the limb of the user.

19. A walker for facilitating movement of a user, the walker comprising:

a carriage;

a frame;

a supporting part connected to the frame;

a support for a limb of the user swivel-mounted on the supporting part by a first joint having a first axle arranged transverse to a longitudinal axis of the support, the support having an inclination adjustable within a horizontal plane of the longitudinal axis of the support;

a supporting element configured for supporting the support arranged at a distance from the first axle in a direction of the longitudinal axis of the support; and a mechanical-positioning element connecting the supporting element to the supporting part, the mechanical-positioning element configured for manual adjustment;

wherein a vertical position of the supporting element with respect to the supporting part is adjustable using the mechanical-positioning element to thereby adjust inclination of the support for the limb of the user within the horizontal plane in an adjustment range between −10° and +25°.

20. The walker according to claim 19, wherein the adjustment range is between −3° and +15°.

* * * * *